US010964497B2

(12) United States Patent
Meissner et al.

(10) Patent No.: US 10,964,497 B2
(45) Date of Patent: Mar. 30, 2021

(54) DOUBLE-CONTACT SWITCH HAVING VACUUM SWITCHING CHAMBERS

(71) Applicant: Eaton Intelligent Power Limited, Dublin (IE)

(72) Inventors: Johannes Meissner, Bonn (DE); Gerd Schmitz, Niederkassel (DE); Marcel Uedelhoven, Blankenheim (DE); Oliver Kreft, Bonn (DE); Michael Wohlang, Bornheim (DE); Kai Schroeder, Niederkassel (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/620,532

(22) PCT Filed: Jun. 6, 2018

(86) PCT No.: PCT/EP2018/064856
§ 371 (c)(1),
(2) Date: Jan. 28, 2020

(87) PCT Pub. No.: WO2018/228882
PCT Pub. Date: Dec. 20, 2018

(65) Prior Publication Data

US 2020/0312593 A1 Oct. 1, 2020

(30) Foreign Application Priority Data

Jun. 11, 2017 (DE) ..... 10 2017 112 813.1

(51) Int. Cl.
*H01H 33/662* (2006.01)
*H01H 33/664* (2006.01)

(52) U.S. Cl.
CPC .... *H01H 33/66261* (2013.01); *H01H 33/664* (2013.01); *H01H 33/66207* (2013.01); *H01H 33/66238* (2013.01)

(58) Field of Classification Search
CPC ..... H01H 33/66261; H01H 33/66207; H01H 33/66238; H01H 33/664; H01H 33/6662;
(Continued)

(56) References Cited

U.S. PATENT DOCUMENTS 2,264,024 A * 11/1941 Glashan ..... H01H 35/38 200/82 D
3,405,245 A * 10/1968 Toshio Ito ..... H01H 33/6647 218/126

(Continued)

FOREIGN PATENT DOCUMENTS

DE 3020800 A1 12/1981
JP S52113371 U 8/1977

(Continued)

OTHER PUBLICATIONS

Written Opinion of the International Searching Authority of PCT/EP2018/064856 dated Sep. 20, 2018, p. 1-7.

*Primary Examiner* — William A Bolton
(74) *Attorney, Agent, or Firm* — Leydig, Voit & Mayer, Ltd.

(57) ABSTRACT

A double-contact switch includes: a first and second tubular vacuum switching chamber formed as partial switching chambers of a switching tube; an electrode fixed in the switching tube and arranged between the first and second vacuum switching chambers and having a first fixed contact projecting into the first vacuum switching chamber and a second fixed contact projecting into the second vacuum switching chamber; a first electrode arranged in the first vacuum switching chamber and movable within the first vacuum switching chamber in an axial direction thereof, the (Continued)

first electrode having a region which bears a contact and is closed off in a gastight manner relative to an exterior of the first vacuum switching chamber; a second electrode arranged in the second vacuum switching chamber and movable within the second vacuum switching chamber in an axial direction thereof, the second electrode having a region which bears a contact.

7 Claims, 5 Drawing Sheets

(58) Field of Classification Search
CPC ..... H01H 33/666; H01H 2033/6668; H01H 33/14; H01H 9/54; H01H 89/00; H01H 2033/66253; H01H 3/001; H01H 33/66
USPC ..... 218/124, 118, 123, 139, 140
See application file for complete search history.

(56) References Cited

U.S. PATENT DOCUMENTS

| | | | | |
|---|---|---|---|---|
| 4,492,837 | A * | 1/1985 | Crouch | H01H 33/66 200/83 D |
| 5,543,598 | A * | 8/1996 | Duffour | H01H 33/66238 218/135 |
| 8,947,188 | B2 * | 2/2015 | Hammer | H01H 9/0038 336/150 |
| 9,165,726 | B2 * | 10/2015 | Dohnal | H01H 9/0038 |
| 9,196,439 | B2 * | 11/2015 | Gentsch | H01H 33/666 |
| 9,293,273 | B2 * | 3/2016 | Albrecht | H02P 13/06 |
| 2016/0322184 | A1 | 11/2016 | Meissner et al. | |
| 2016/0322185 | A1 | 11/2016 | Meissner et al. | |

FOREIGN PATENT DOCUMENTS

| | | |
|---|---|---|
| WO | WO 2015091096 A1 | 6/2015 |
| WO | WO 2015091105 A1 | 6/2015 |

* cited by examiner

DOUBLE-CONTACT SWITCH HAVING VACUUM SWITCHING CHAMBERS

CROSS-REFERENCE TO PRIOR APPLICATIONS

This application is a U.S. National Phase application under 35 U.S.C. § 371 of International Application No. PCT/EP2018/064856, filed on Jun. 6, 2018, and claims benefit to German Patent Application No. DE 10 2017 112 813.1, filed on Jun. 11, 2017. The International Application was published in German on Dec. 20, 2018 as WO 2018/228882 under PCT Article 21(2).

FIELD

The invention relates to a double-contact switch with vacuum switching chambers which is particularly suitable for use in a hybrid switching arrangement and a hybrid switching device.

BACKGROUND

International patent application WO 2015/091105 A1 discloses a hybrid switching arrangement for a hybrid switching device; in this document see FIG. 1. In order to switch high DC currents in the range above 500 amps while ensuring galvanic isolation after switching-off operations, a hybrid switch with a mechanical contact arrangement in the form of a special vacuum switching chamber is suitable, as has been presented in WO 2015/091096 A1. In this advantageous switching arrangement, two serially arranged contact pairs are connected via two independently actuated movable switching electrodes actuated independently of one another (in this document see FIG. 2). In a switching operation, one of the two contact pairs (the "commutation contact") is used to commutate the load current onto a semiconductor switch, preferably in the form of an IGBT, where this current is then brought down to zero within a very short time, while the second contact pair (the "isolating contact") finally ensures the galvanic separation of the parallel arrangement of commutation contact and semiconductor switch responsible for current disconnection.

In order to ensure as high a functional reliability as possible, in particular when switching currents in the range of a few hundred amps, care must be taken among other things in the design of such switches or switching arrangements that when such high currents are switched on permanent welding of the switching contacts does not occur. A welding of switching contacts can occur above all during the mechanical bounce at the moment of re-contacting.

In case of the aforementioned hybrid switching arrangements, a welding of in particular the commutation contacts can be successfully prevented by briefly activating the parallel-arranged power semiconductor during the switching-on phase so that the load current flows exclusively through said power semiconductor. During this phase which is critical for the welding of contacts, the commutation contact thereby remains load-free.

Under certain circumstances, a welding of the contact pair of the first circuit-breaker to which no semiconductor switch is connected in parallel can occur, for example when it closes at approximately the same time that the commutation contact closes. Since the isolating contact and the commutation contact are arranged in series both electrically and mechanically, a welding of the isolating contact is possible in principle during the phase of the switch-on bounce if, at the moment of its brief lifting, a load current is already flowing through the commutation contact or even through the semiconductor switch.

Japanese Utility Model JP S52 113371 U describes a double-contact switch with vacuum switching chambers and stop means which limit the path of movable contacts.

SUMMARY

In an embodiment, the present invention provides a double-contact switch, comprising: a first and second tubular vacuum switching chamber formed as partial switching chambers of a switching tube; an electrode fixed in the switching tube and arranged between the first and second vacuum switching chambers and having a first fixed contact projecting into the first vacuum switching chamber and a second fixed contact projecting into the second vacuum switching chamber; a first electrode arranged in the first vacuum switching chamber and movable within the first vacuum switching chamber in an axial direction thereof, the first electrode having a region which bears a contact and is closed off in a gastight manner relative to an exterior of the first vacuum switching chamber; a second electrode arranged in the second vacuum switching chamber and movable within the second vacuum switching chamber in an axial direction thereof, the second electrode having a region which bears a contact and is closed off in a gastight manner relative to an exterior of the second vacuum switching chamber, the second electrode being fixed with respect to the switching tube, wherein the first electrode for opening and closing the contacts is movable with respect to the switching tube, wherein stop means are provided such that an axial movement of the first electrode for opening the switching contacts in the vacuum switching chambers is limited to a preset distance relative to the switching tube, and when the stop means come up against each other a mechanical impulse acting on the switching tube is generated in a direction of the axial movement of the movable electrode in order to break apart any possibly existing welding of the contacts, and wherein the stop means have a step on a shaft of the first electrode and a stop face for the step, which stop face is formed by an inner end face of a guide collar for the first electrode.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1A:
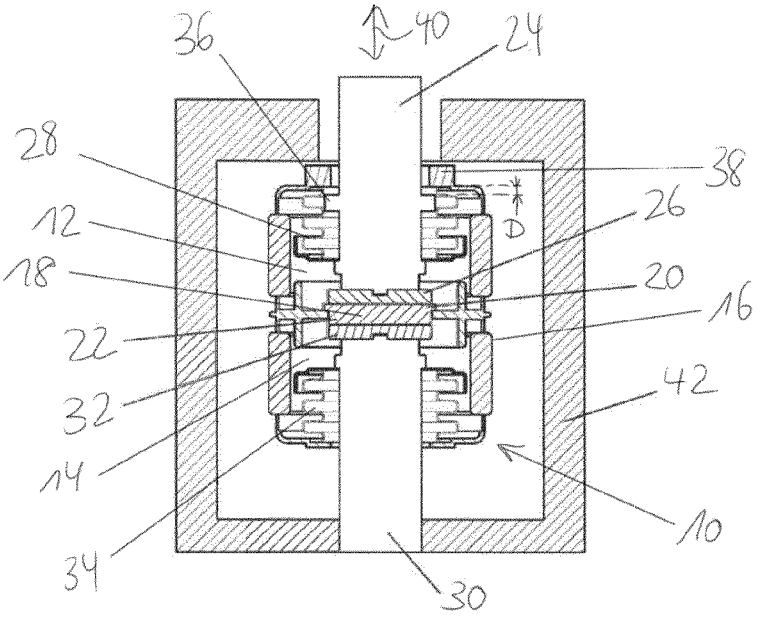
FIGS. 1*a* to 1*c* show different phases of a disconnection process in a double-contact switch with vacuum switching chambers according to a first exemplary embodiment of the invention.

In an embodiment, the present invention provides a further improvement of double-contact switch with vacuum switching chambers that is known from patent application WO 2015/091096 A1.

An idea underlying the present invention consists in structurally modifying the double-contact switch known from WO 2015/091096 A1 in such a way that stop means are provided which, during the opening of the switching contacts, limit the axial movement of a movable electrode of the switch with respect to a switching tube of the switch such that when the stop means come up against each other a mechanical impulse acting on the switching tube is generated in the direction of the axial movement of the movable electrode in order to break apart any possibly existing welding of the contacts. In other words, according to the invention, the axial movement of the movable electrode is limited to such an extent by the stop means that in the case of a normal opening movement in which the movable electrode is moved by a preset distance, it comes up against a stop and an accompanying mechanical impulse occurs which acts on the switching tube. The mechanical impulse is in this case dimensioned such that any existing welding of the contacts, for example between an electrode provided in the switching tube and a fixed electrode, can be broken apart.

According to one embodiment, the invention now relates to a double-contact switch having a first and a second tubular vacuum switching chamber that are designed as partial switching chambers of a switching tube; an electrode fixed in the switching tube and arranged between the first and second vacuum switching chambers and having a first fixed contact projecting into the first vacuum switching chamber and a second fixed contact projecting into the second vacuum switching chamber; a first electrode arranged in the first vacuum switching chamber and movable within it in the axial direction and having a region that bears a contact and is closed off in a gastight manner from the exterior of the first vacuum switching chamber; a second electrode arranged in the second vacuum switching chamber and movable within it in the axial direction and having a region that bears a contact and is closed off in a gastight manner from the exterior of the second vacuum switching chamber. The second electrode is fixed with respect to the switching tube while for opening and closing the contacts the first electrode is movable with respect to the switching tube. Stop means are provided in the switch in such a way that the axial movement of the first electrode for opening the switching contacts in the vacuum switching chambers is limited to a preset distance relative to the switching tube and, when the stop means collide, a mechanical impulse acting on the switching tube is generated in the direction of the axial movement in order to break apart any possibly existing welding of the contacts.

The preset distance is in particular shorter than a maximum possible switching stroke of the first electrode for opening the switching contacts in the vacuum switching chambers. This makes it possible to ensure that a sufficiently strong mechanical impulse is generated when the stop means collide in order to break apart any welds.

In particular, the switch may have a housing in which the second electrode is fixed and which has an opening for movable mounting of the first electrode. The maximum possible switching stroke is defined here by a stop on an upper end face of the switching tube on the housing. The housing can also serve for the attachment of an electromechanical drive for the first movable electrode.

The stop means may have a step on the shaft of the first electrode and a stop face for the step formed by a cover of the switching tube. In this case, the step abuts against the inside of the cover of the switching tube when the first electrode is moved out of the switching tube.

The stop means may also have a step on the shaft of the first electrode and a stop face for the step formed by the inner end face of a guide sleeve for the first electrode. A guide sleeve has the advantage that with a suitable choice of material the impact loads occurring when the stop means collide result in no or substantially less impairment of the other, in some cases more sensitive components of the switching tube, since the step does not impact directly on these components.

The step may be incorporated into the shaft of the first electrode. However, the step can also be formed by a separate component attached to the shaft of the first electrode.

The outer diameter of the step is dimensioned in particular such that no contact with the inside of the gastight barrier can occur during an axial movement of the first electrode.

In the closed state of the contacts, the distance between the step and the stop face can be dimensioned such that it corresponds substantially to a preset nominal opening distance of the first fixed contact and of the range of the first electrode carrying a contact.

The stop means may also comprise a shield of a gastight barrier of the first vacuum switch chamber and a stop face for the shield formed by the inside of a cover of the switching tube.

Further advantages and possible applications of the present invention result from the following description in conjunction with the exemplary embodiments illustrated in the drawings.

In the following description, the same functionally equivalent and functionally related elements may be provided with the same reference numerals. Absolute values are given below by way of example only and are not to be construed as limiting the invention.

The principle of operation of the double-contact switch according to the invention will now be explained with reference to FIGS. 1*a* to 1*c* which show the double-contact switch during a switching-off sequence with previously welded isolating contacts.

FIG. 1*a* shows the double-contact switch 10 and the state of its switching tube 16 in the switched-on case. The switching tube 16 has a first vacuum switching chamber 12 and a second vacuum switching chamber 14, both formed as partial switching chambers of the switching tube 16.

A stationary electrode 18 which divides the switching tube 16 into the two partial switching chambers 12 and 14 is arranged approximately centrally in the switching tube 16. The fixed electrode 18 has a first fixed contact 20 and a second fixed contact 22. The two fixed contacts 20 and 22 can be implemented, for example, by the two end faces of the fixed electrode 18. The first fixed contact 20 projects into the first vacuum switching chamber 12 and the second fixed contact projects into the second vacuum switching chamber 14.

A first electrode 24 movable in the axial direction is arranged in the first vacuum switching chamber 12. The electrode 24 has a region 26 which bears a contact, which serves to contact the first fixed contact 20 of the electrode 18 and forms a first isolating contact of the switch 10 which can serve, for example, as a commutation contact in a hybrid switching arrangement. The region 26 and a part of the electrode 24 are closed off in a gastight manner by means of a metal bellows 28. For this purpose, the metal bellows 28 is connected at one end to the shaft of the electrode 24 and at the other end to the front end of the first vacuum switching chamber 12.

Also arranged in the second vacuum switching chamber 14 is a second electrode 30 with a region 32 bearing a contact, which second electrode in principle is movable in the axial direction like the first electrode 24, but which in the switch 10 shown is fixed with respect to the switching tube 16. The second electrode 30 can be attached in different ways; in the switch 10 shown in FIG. 1*a*, the second electrode 30 is attached to a housing 42 of the switch 10. Like the first electrode 24, a partial region 32 of the second electrode 30 is closed off in a gastight manner by a metal bellows 34. The contacts 22 and 32 here form a second isolating contact of the switch 10.

In the case of the switch 10 with housing 42 shown in FIG. 1*a*, the switching tube 16 is mounted movably with respect to the fixed second electrode 30 and the first electrode 24 is likewise mounted movably with respect to the switching tube 16 and the second electrode 30. The possible axial direction of movement of the first electrode 24 is indicated by the double arrow 40.

Figure 1B:
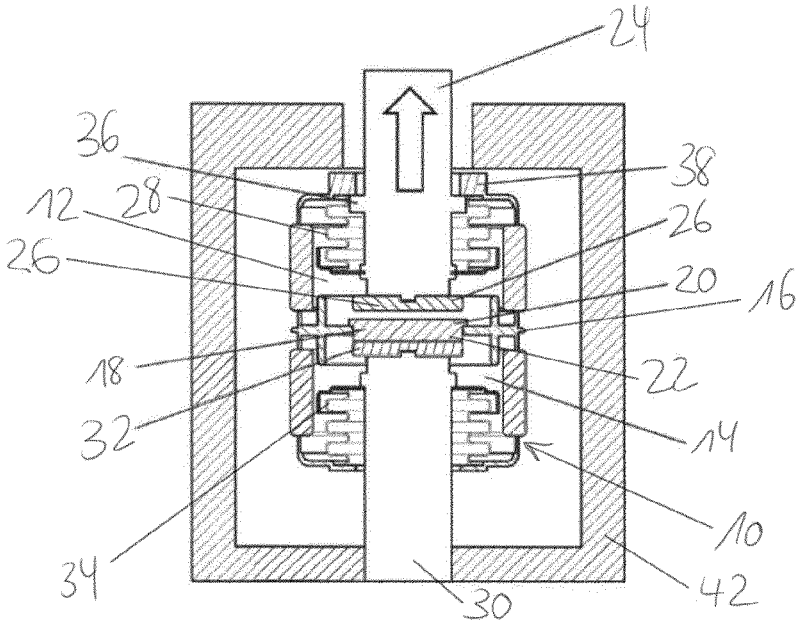

To open the switch contacts 20, 26 and 22, 32 which in FIG. 1*a* are in the closed state, the first electrode 24 is moved upwards out of the housing 42, as shown in FIG. 1*b*. The axial movement of the first electrode 24 is typically produced by an electromechanical switching drive of a switching device in which the switch 10 with the housing 42 is installed. The switching drive can, for example, be connected directly to the shaft of the first electrode 24 via a clamping connection. By the movement of the first electrode 24 the first contact pair 20, 26 or the first isolating contact of the switch 10 is opened, while the contact pair 22, 32 or the second isolating contact, for example, initially remains firmly closed, for example due to a preceding welding. Consequently, no movement of the switching tube 16 takes place in this phase of the opening process of the contacts.

The axial movement of the first electrode 24 with respect to the switching tube 16 is limited by stop means 36, 38. The stop means comprise a step 36 on the shaft of the first electrode 24 and a stop face 38 formed by the top cover of the switching tube 16. In this way, during outward movement or axial movement of the first electrode 24 in order to open the isolating contact comprising the contacts 20 and 26, the step 36 after a preset distance D comes up against the stop face 38 or the cover of the switching tube 16. A mechanical impulse is generated by this coming together or collision, in particular if the first electrode 24 connected to the switching drive has not yet reached its final position. Due to the mechanical impulse, the switching tube 16 experiences a shock load which is transferred directly to the contact pair 22, 32. Depending on the force reserve and the electro-mechanical switching drive as well as on the contact material of the contact pair 20, 32 the shock or impulse load is generally sufficient to break apart any welding of contacts 22 and 32. With the separation of the contacts 22 and 32, a movement of the switching tube 16 is thus initiated in such a way that it also sets said switching tube in motion in the direction of action of the electromechanical drive and thereby brings about the further opening of the contacts 22, 32 of the second isolating contact; see FIG. 1*c*.

The opening movement of the contacts of the switch 10 is stopped as soon as the outer end face of the top cover of the switching tube 16 meets the inner wall of the housing 42 serving as stop face for the switching tube 16, thereby producing the contact opening distances of the two contact pairs of the switch 10 after switch-off.

Figure 1C:
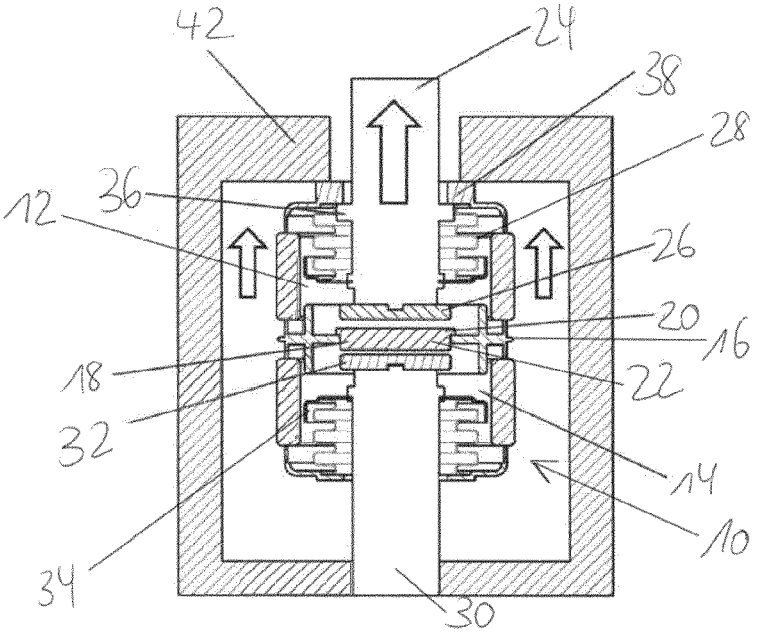
Figure 2:
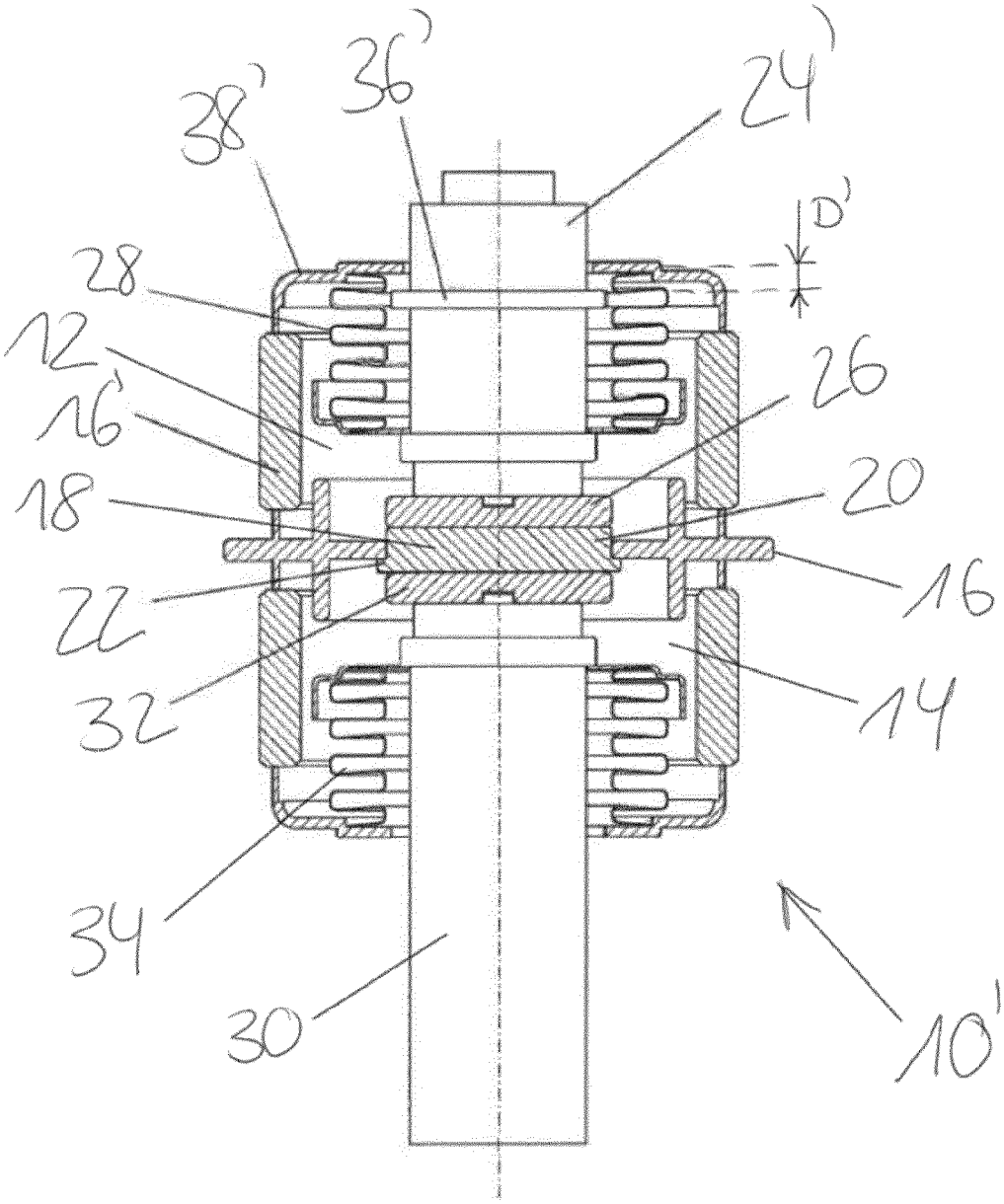
FIGS. 2 to 4 show cross-sectional views of double-contact switches with vacuum switching chambers according to three different exemplary embodiments of the invention.

FIG. 2 shows a double-contact switch 10' similar in design to the switch 10 shown in FIGS. 1*a* to 1*c* and in which the stop means are also formed by a step 36' and the top cover 38' of the switching tube 16. The step 36' can be incorporated into the shaft of the first electrode 24', for example, by turning. Alternatively, the step 36' can also be formed as a separate component, for example by means of a snap ring which is mounted in a circumferential groove on the shaft of the first electrode 24'. The outer diameter of the step 36' is generally selected such that there is no contact with the sensitive metal bellows 28 during a movement of the first electrode 24'. The relative movement of the first electrode 24' with respect to the switching tube 16 is limited by the stop means 36', 38' to the preset distance D', which is in particular less than a maximum possible switching stroke of the first electrode 24'. The preset distance D' corresponds here to the distance between the step 36' and the inside of the top cover 38' when the contacts 20 and 26 are closed; that is to say, the first electrode 24' is not moved out of the switching tube 16, i.e. in the closed state of the two isolating contacts 20, 26 of the switch 10'. In particular, the preset distance D' corresponds to a nominal opening distance of the two contacts 20, 26.

Figure 3:
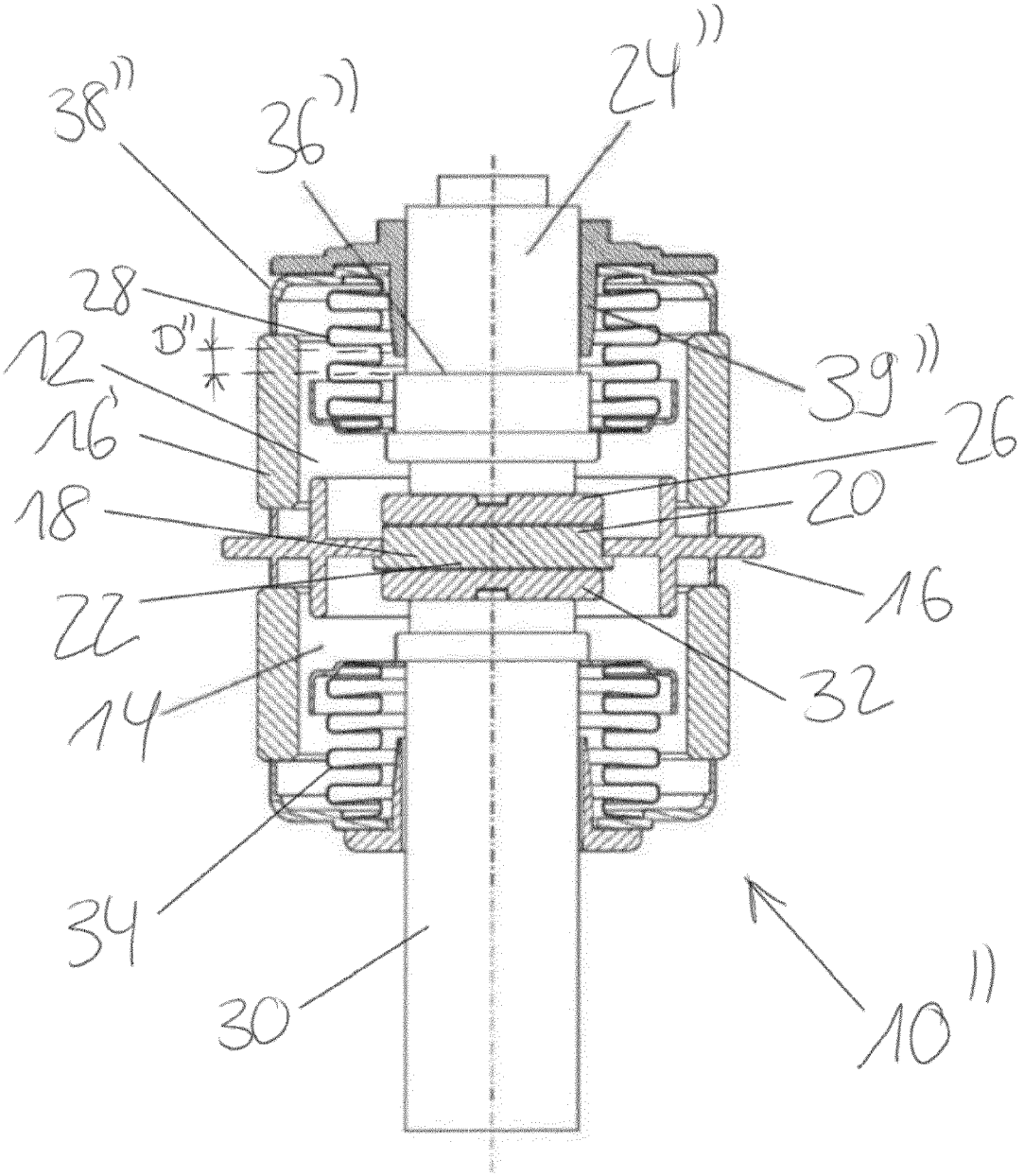

FIG. 3 shows a double-contact switch 10" in which, in contrast to the switch 10' shown in FIG. 2, the top cover 38" of the switching tube 16 is not used as a stop face for a step 36" of the shaft of the first electrode 24" but a guide sleeve 39" which is inserted into the top cover 38" and is in particular made from a plastic. The guide collar 39" thus fulfills two functions: on the one hand it serves as a precise guide for the first movable electrode 24", and on the other hand its inner end face forms a stop face for the step 36". The switch 10" is shown in FIG. 3 with both isolating contacts in the closed state, in which the preset distance D" corresponds to the distance between the step 36" and the inside end face of the guide collar 39", which is used as the stop face. The guide collar 39" can in particular be made of a special plastic, with which vacuum switching chambers are usually equipped, in order to ensure a centered axial guidance of the movable electrode 24" during the switching process. For additional impact loads, a permanent attachment of the guide sleeve 39" to the switching tube 16 can also be effected, for example, by means of a suitable screw connection on the cover 38" of the switching tube 16. It is also conceivable for the guide sleeve 39" to be attached by means of welds or even by latch hooks integrated into the sleeve.

Figure 4:
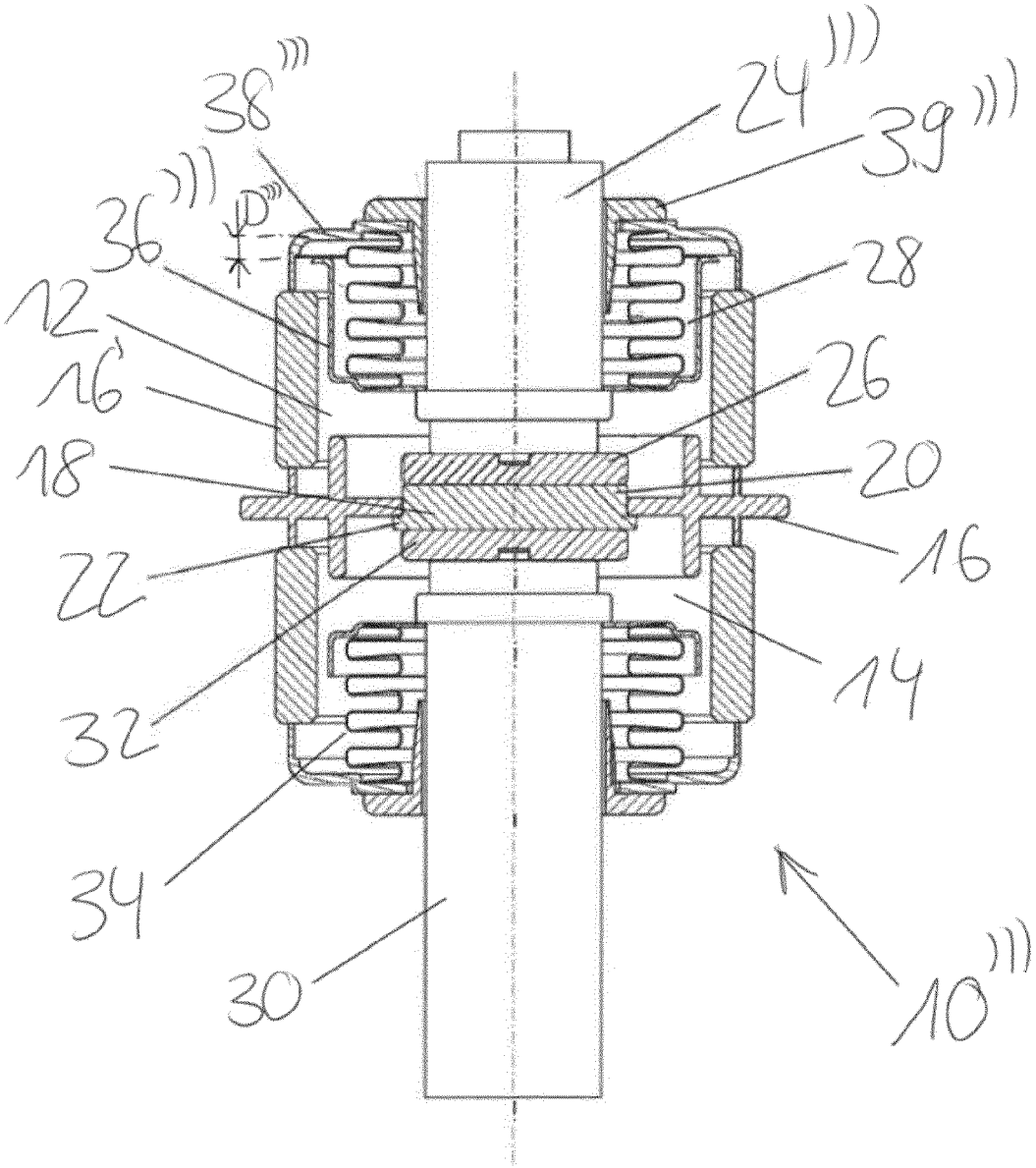

In contrast to the switches shown in FIGS. 2 and 3 as stop means, in the case of the switch 10' shown in FIG. 4, a shield 36' is provided which at least partially encloses the metal bellows 28. The shield 36'" is attached to the end of the metal bellows 28 that is attached to the shaft of the first electrode 24'" and is entrained in a movement of the first electrode 24'" while at the same time the metal bellows 28 is compressed by the movement of the electrode 24'" out of the switching tube 16. The inner side of the top cover 38'" of the switching tube 16 serves as a stop face for the shield 36". As soon as the movable electrode 24' is moved out of the switching tube 16 by the nominal opening distance D'", a collision occurs between the shield 36'" and the inside of the top cover 38' of the switching tube 16. The shield 36'" (also called a "bellows shield") serves primarily to shield the bellows 28, which due to its low wall thickness is very sensitive to the metal vapor typically emitted during the switching-off process, involving as it does vacuum arcing, and also to hot contact particles. To enable it to be used as stop means, the shield 36' is extended to such an extent that the front-end distance of the shield from the inside of the cover 38'" in the closed state of the isolating contacts 20, 26 of the switch 10'" corresponds to the nominal opening distance of the contacts 20, 26 or to the preset distance D'''. With respect to the distribution of the energy of a shock pulse in order to break apart a contact weld over a larger area, the end face of the shield 36''' may be crimped parallel to the lid 38'. As in the case of the switch shown in FIG. 3, a guide collar 39''' is provided in this switch 10' for the precise guidance of the first electrode 24''.

Several design options for the switches described above are explained below: with regard to repetitive impact loads in the case of welded contacts, the top cover of the switching tube, if it serves as a stop face for a step or a shield, can be manufactured, for example, from a stainless steel of sufficient wall thickness. The cover's edge face facing the first vacuum switching chamber can be soldered to the latter via a special metalization layer of a ceramic ring 16' serving as an electrical insulator, which in practice can ensure a sufficiently high strength of this vacuum-tight soldered connection even at high numbers of switching operations as in the case of contactors.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A double-contact switch, comprising:

a first and second tubular vacuum switching chamber formed as partial switching chambers of a switching tube;

a stationary electrode fixed in the switching tube and arranged between the first and second vacuum switching chambers and having a first fixed contact projecting into the first vacuum switching chamber and a second fixed contact projecting into the second vacuum switching chamber;

a first electrode arranged in the first vacuum switching chamber and movable within the first vacuum switching chamber in an axial direction thereof, the first electrode having a region which bears a first electrode contact and is closed off in a gastight manner relative to an exterior of the first vacuum switching chamber;

a second electrode arranged in the second vacuum switching chamber and movable within the second vacuum switching chamber in an axial direction thereof, the second electrode having a region which bears a second electrode contact and is closed off in a gastight manner relative to an exterior of the second vacuum switching chamber, wherein the first electrode for opening and closing the contacts is movable with respect to the switching tube, wherein stop means are provided such that an axial movement of the first electrode is limited to a preset distance relative to the switching tube, and when the stop means come up against each other a mechanical impulse acting on the switching tube is generated in a direction of the axial movement of the first electrode in order to break apart any possibly existing welding of the second fixed contact and the second electrode contact, and wherein the stop means comprise a step on a shaft of the first electrode and a stop face for the step, which stop face is formed by an inner end face of a guide collar for the first electrode.

2. The switch according to claim 1, wherein the preset distance is less than a maximum possible switching stroke of the first electrode for opening the first fixed contact and the first electrode contact.

3. The switch according to claim 2, further comprising a housing in which the second electrode is fixed and which has an opening for movable mounting of the first electrode, the maximum possible switching stroke being defined by a stop on an end face of the switching tube on the housing.

4. The switch according to claim 1, wherein the step is formed by a separate component attached to the shaft of the first electrode.

5. The switch according to claim 1, wherein an outer diameter of the step is dimensioned such that no contact with an inside of the gastight barrier occurs during the axial movement of the first electrode.

6. The switch according to claim 1, wherein a distance between the step and the stop face in a closed state of the first fixed contact and the first electrode contact is dimensioned so as to correspond substantially to a preset nominal opening distance of the first fixed contact and the region of the first electrode bearing the first electrode contact.

7. A double-contact switch, comprising:

a first and second tubular vacuum switching chamber comprising partial switching chambers of a switching tube;

a stationary electrode fixed in the switching tube and arranged between the first and second vacuum switching chambers, the stationary electrode having a first fixed contact projecting into the first vacuum switching chamber and a second fixed contact projecting into the second vacuum switching chamber;

a first electrode arranged in the first vacuum switching chamber and movable in the first vacuum switching chamber in an axial direction thereof, the first electrode having a region which bears a first electrode contact and is closed off in a gastight manner relative to an exterior of the first vacuum switching chamber; and a second electrode arranged in the second vacuum switching chamber and movable in the second vacuum switching chamber in an axial direction thereof, the second electrode having a region which bears a second electrode contact and is closed off in a gastight manner relative to an exterior of the second vacuum switching chamber, wherein the first electrode is movable with respect to the switching tube, wherein stop means are provided such that axial motion of the first electrode in the first vacuum switching chamber is limited to a predetermined distance relative to the switching tube, and if the stop means hit one another, a mechanical impulse acting on the switching tube is produced in a direction of the axial motion to break apart any possibly existing welds of the second fixed contact and the second electrode contact, and wherein the stop means comprise a shield of a gastight barrier of the first vacuum switching chamber and a stop face for the shield, the stop face being formed by an inside of a cover of the switching tube.

* * * * *